US010869137B2

(12) United States Patent
Nardin et al.

(10) Patent No.: US 10,869,137 B2
(45) Date of Patent: Dec. 15, 2020

(54) ACOUSTIC SPEAKER HAVING A ONE-PIECE PLASTIC SHELL

(71) Applicant: DEVIALET, Paris (FR)

(72) Inventors: Emmanuel Nardin, Paris (FR); Antonio Oliveira, Puteaux (FR); Jérémy Beigeaud, Chessy (FR); Max Rainer, Paris (FR); Nicolas Regentête, Paris (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 16/592,463

(22) Filed: Oct. 3, 2019

(65) Prior Publication Data

US 2020/0112797 A1 Apr. 9, 2020

(30) Foreign Application Priority Data

Oct. 8, 2018 (FR) ..... 18 59306

(51) Int. Cl.
*H04R 11/02* (2006.01)
*H04R 1/02* (2006.01)

(52) U.S. Cl.
CPC ..... *H04R 11/02* (2013.01); *H04R 1/025* (2013.01); *H04R 2201/029* (2013.01)

(58) Field of Classification Search
CPC ... H04R 11/02; H04R 1/025; H04R 2201/029
USPC ..... 381/335
See application file for complete search history.

(56) References Cited

U.S. PATENT DOCUMENTS 4,805,221 A 2/1989 Quaas
2016/0360311 A1 12/2016 Nardin et al.

FOREIGN PATENT DOCUMENTS

CN 207910991 9/2018

OTHER PUBLICATIONS

Jan Selley, Naim Mu-So QB Review. Can Naim make their Philosophy work at 600? Jan. 30, 2016, pp. 1-9.
Michael Brown, Devialet Phantom Review: Forget everything you thought you knew about speaker technology, Nov. 13, 2015.
Preliminary Search Report dated May 23, 2019 Application No. FR1859306.

*Primary Examiner* — Quynh H Nguyen
(74) *Attorney, Agent, or Firm* — B. Aaron Schulman, Esq.; Stites & Harbison, PLLC

(57) ABSTRACT

An acoustic speaker (1) including:
- a metal armature (7),
- a plastic shell (9) fastened on the armature, the shell defining at least two openings (11A, 11B), and
- at these two loudspeakers (13A, 13B) arranged head to tail along a transverse axis (T), the two loudspeakers respectively extending through the two openings.

Figure 1:
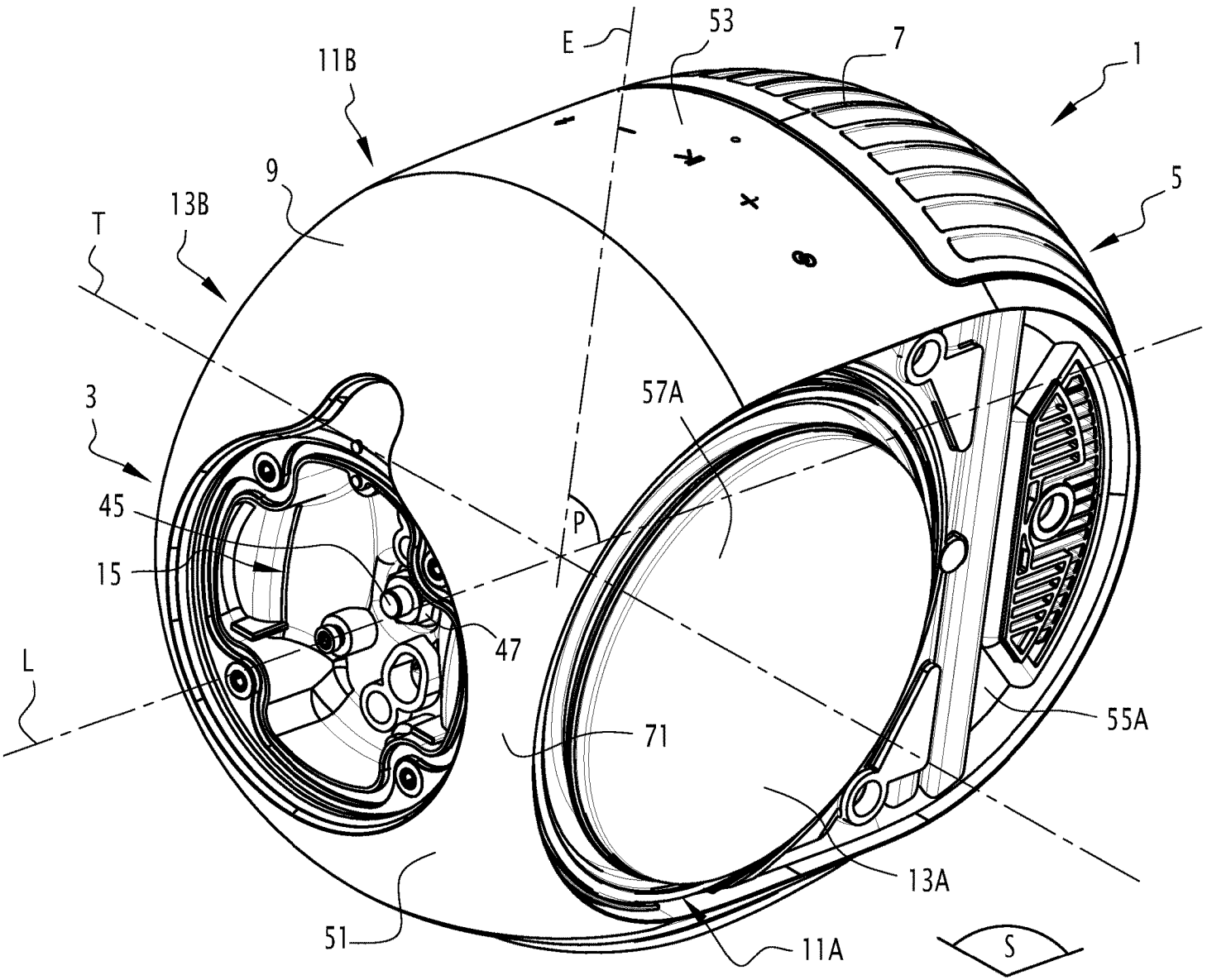

The shell is in one piece, and the shell and an outer part (19) of the armature are suitable for nesting in one another along a longitudinal axis (L), the outer part and the shell at least partially defining an inner volume (23) of the acoustic speaker.

14 Claims, 6 Drawing Sheets

ACOUSTIC SPEAKER HAVING A ONE-PIECE PLASTIC SHELL

The present invention relates to an acoustic speaker, including:

a metal armature, a plastic shell fastened on the armature, the shell defining at least two openings, and at least two loudspeakers arranged back-to-back along a transverse axis, the two loudspeakers respectively extending through the two openings.

In a compact acoustic speaker, the loudspeakers, in particular woofers, are relatively bulky elements. They are arranged head to tail so that the movements of their membranes do not create vibrations that could cause untimely movements of the acoustic speaker.

Due to their significant volume and this relative position, the loudspeakers are fastened on distinct portions of the shell relative to one another, for example by screws. Then, the distinct portions are assembled with respect to one another to form the shell and place the two loudspeakers in their head-to-tail position.

As a result, the shell has assembly lines, such as joints, that are perceptible to the eye or the touch by a user of the acoustic speaker, particularly given that the latter is compact. Such assembly lines are sometimes considered not to be esthetically pleasing, since they are detrimental to the smooth appearance of the acoustic speaker.

The invention aims to propose an acoustic speaker having a smoother appearance, generally perceived as being more esthetically pleasing by a user.

To that end, the invention relates to an acoustic speaker of the type described above, in which:

the shell is in one piece, and the shell and an outer part of the armature are suitable for nesting in one another along a longitudinal axis, the outer part and the shell at least partially defining an inner volume of the acoustic speaker.

According to specific embodiments, the acoustic speaker includes one or more of the following features, considered alone or according to any technically possible combinations:

the acoustic speaker [being] oblong along the longitudinal axis, a rear part of the acoustic speaker along the longitudinal axis being formed by the outer part of the armature, and a front part of the acoustic speaker along the longitudinal axis being at least partially formed by the shell;

the armature comprises an inner part located between the two loudspeakers along the transverse axis, the shell being fastened on the inner part by a screw-nut system, preferably by a single screw-nut system;

the two loudspeakers are rigidly fastened on the inner part of the armature, and are preferably devoid of any rigid connection with the shell other than that formed by the armature;

the shell and the outer part of the armature respectively include two curved edges, the two curved edges being adjacent to one another, the acoustic enclosure including a sealing gasket arranged between the two curved edges and forming a loop extending along the two curved edges;

the shell is generally U-shaped seen along an axis orthogonal to the longitudinal axis and the transverse axis, and the outer part of the armature is generally U-shaped seen along the transverse axis;

the two openings are respectively delimited by two edges, preferably circular, the acoustic speaker comprising at least two metal inserts respectively overmolded by said two edges;

each of the two loudspeakers comprises a membrane suitable for emitting sound waves, and the shell comprises, successively along the longitudinal axis, a front part forming a sphere portion, an intermediate part forming a cylinder portion, and two back walls located longitudinally behind the membranes of the two loudspeakers;

the acoustic speaker further comprises two metal inserts respectively overmolded by the back walls of the shell; and the shell comprises:

an inner layer including polycarbonate, and between 15% and 25% by weight of glass fibers, and an outer layer including acrylonitrile butadiene styrene (ABS).

Figure 2:
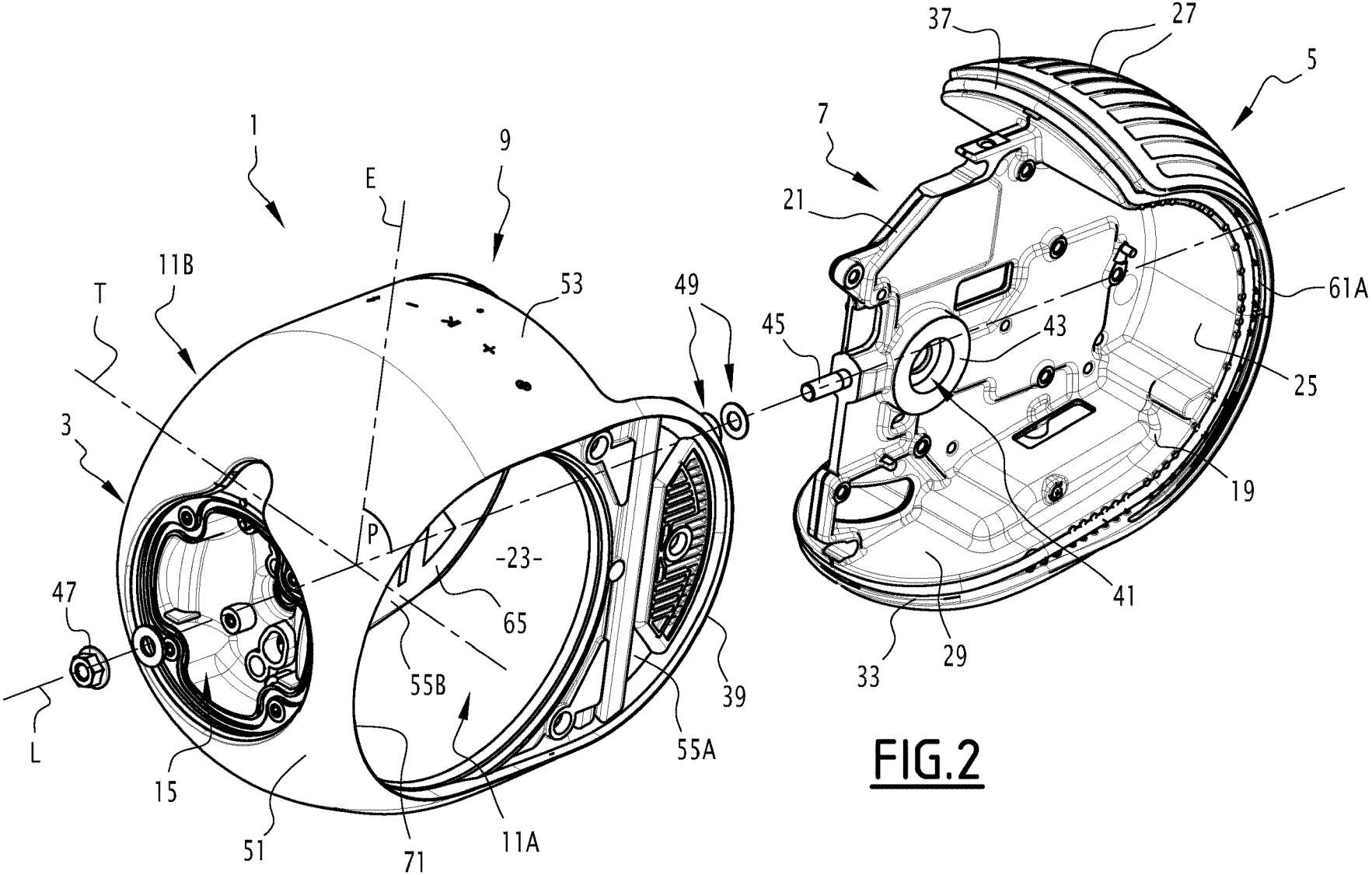
Figure 3:
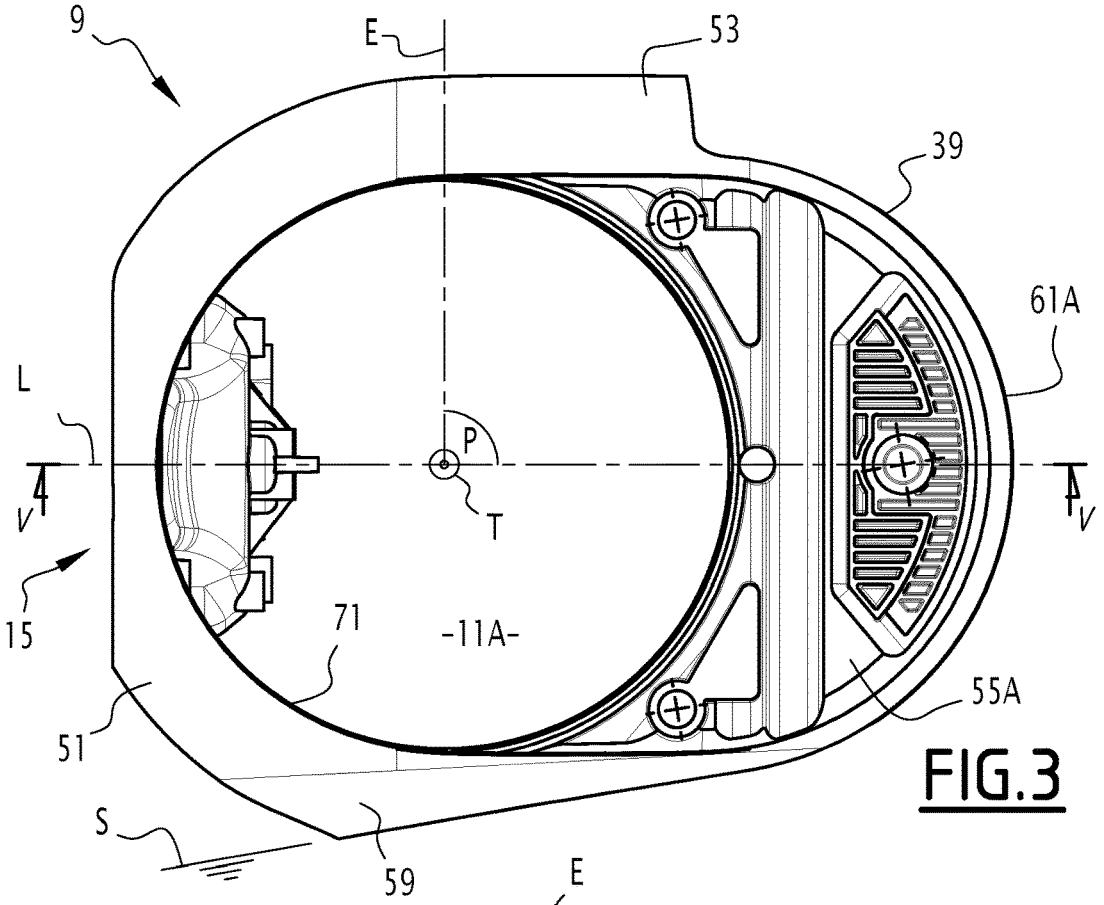
Figure 4:
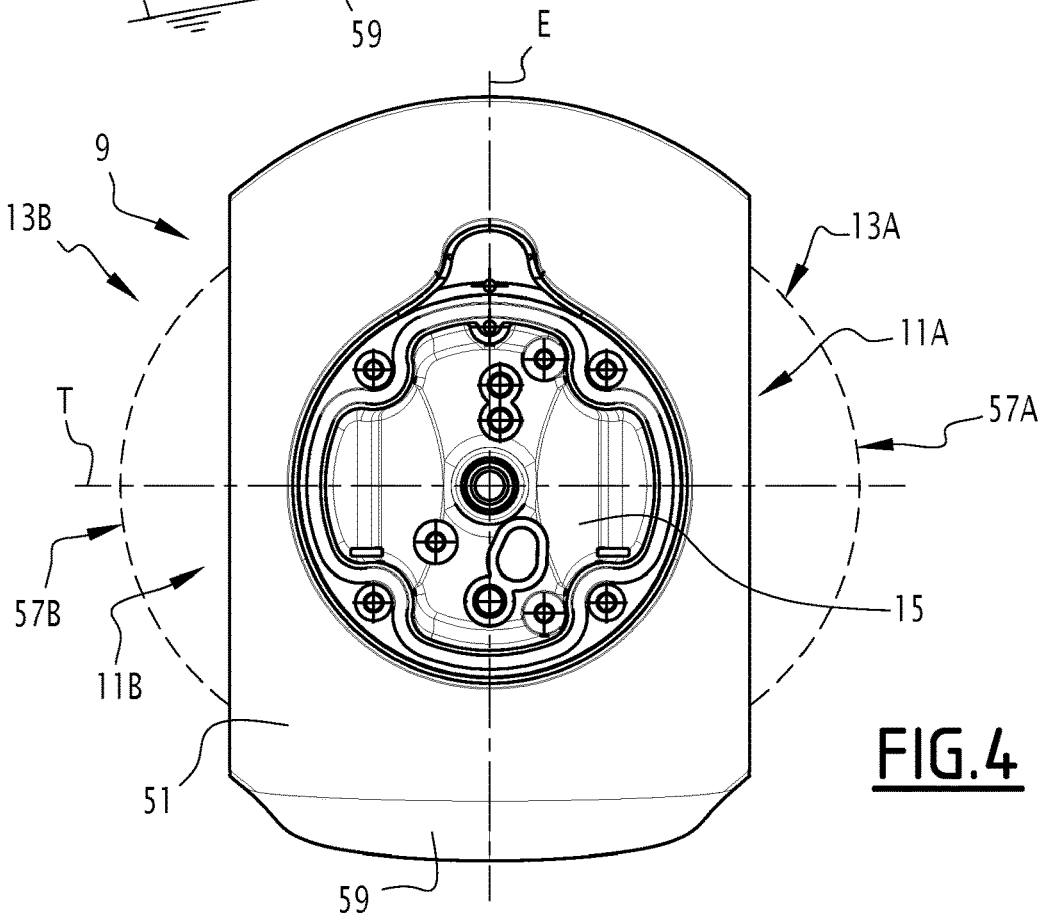
Figure 5:
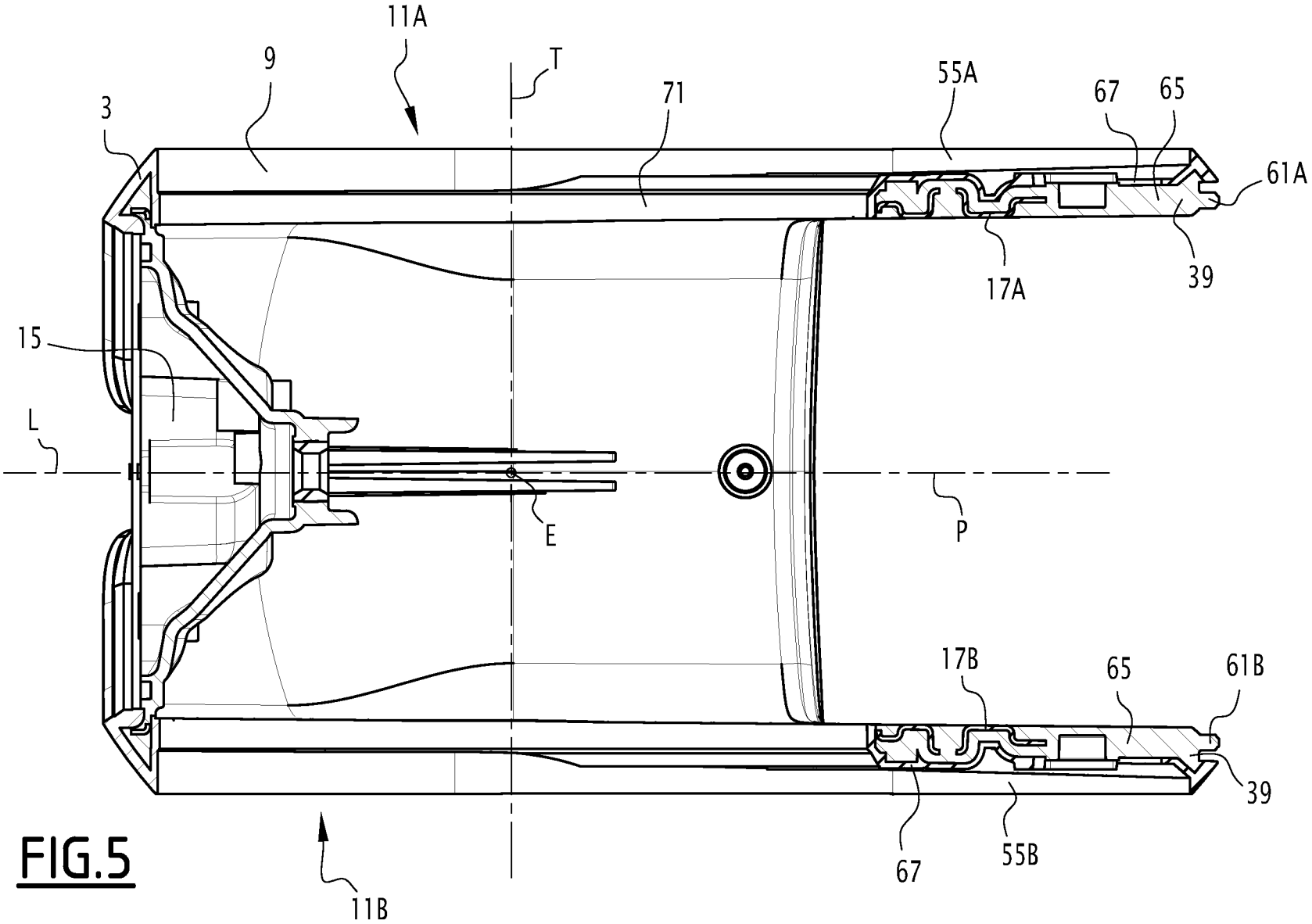
Figure 6:
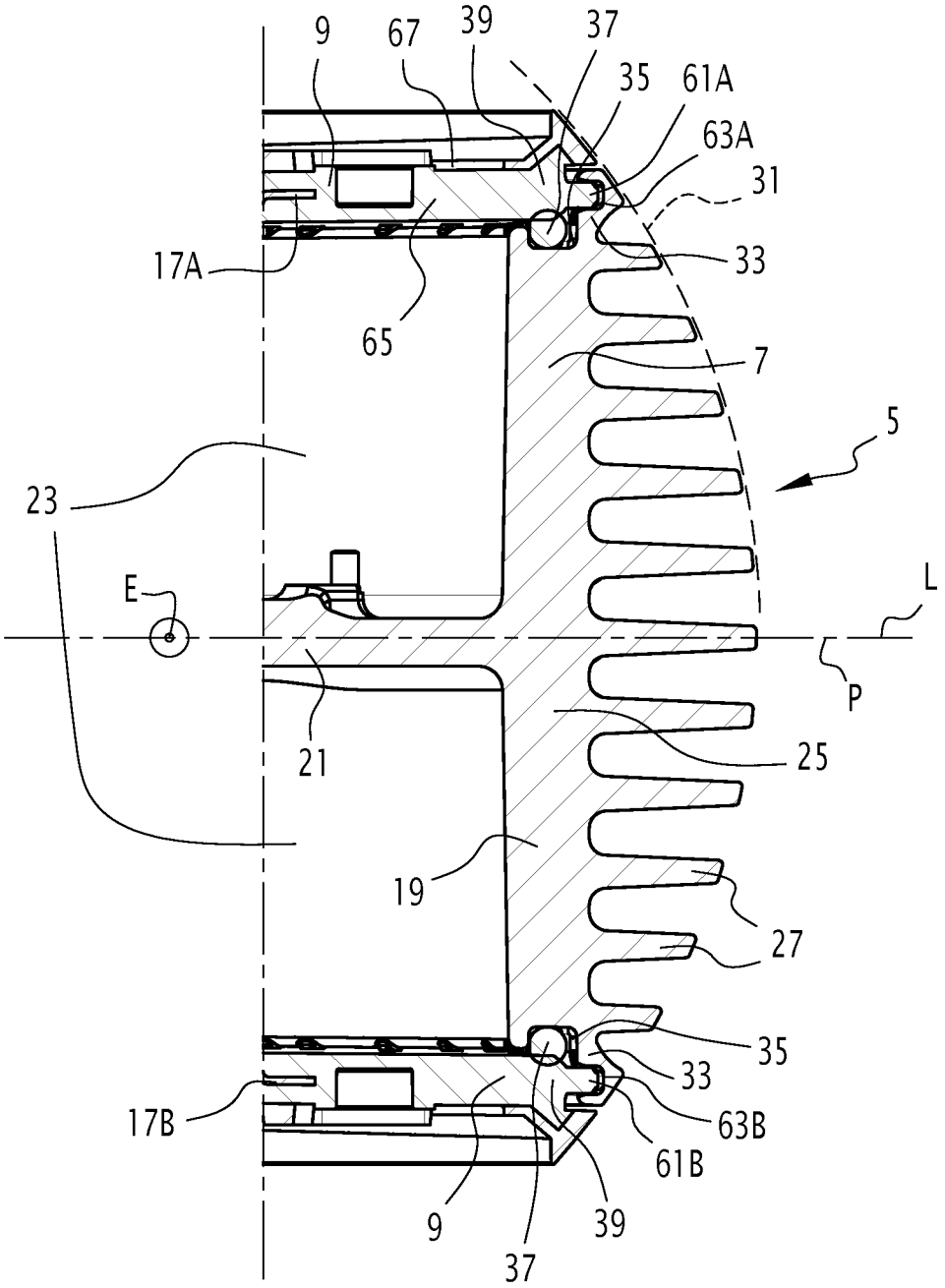
Figure 7:
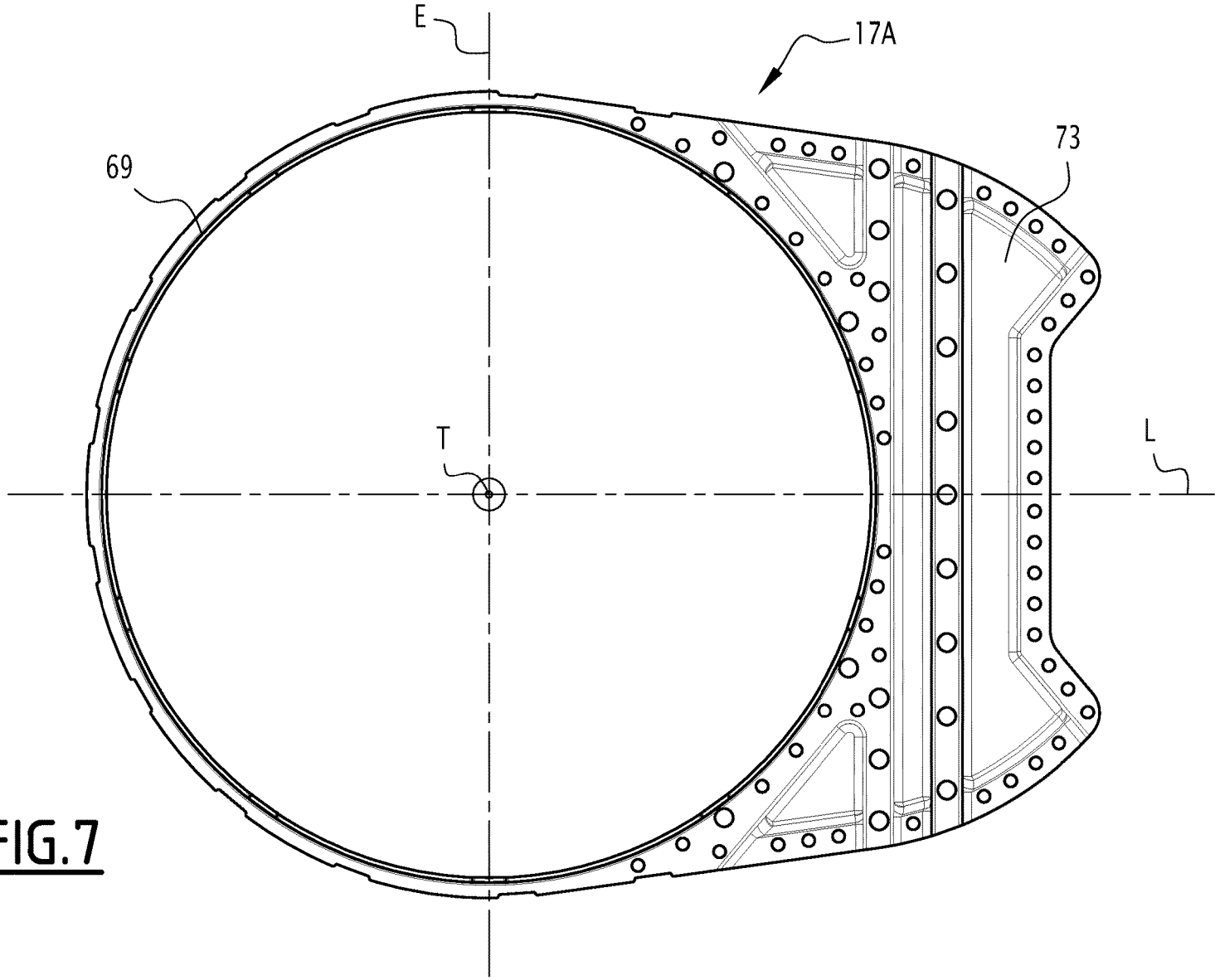

The invention will be better understood upon reading the following description, provided solely as an example, and done in reference to the appended drawings, in which:

FIG. 1 is a perspective view of an acoustic speaker according to the invention, FIG. 2 is a perspective view of the acoustic speaker shown in FIG. 1, exploded along the longitudinal axis, the loudspeakers and other elements inside the acoustic speaker not being shown, FIG. 3 is a rear view of the pretreatment assembly shown in FIGS. 1 and 2, FIG. 4 is a front view of the acoustic speaker shown in FIGS. 1 and 2, FIG. 5 is a cross-sectional view of the shell shown in FIGS. 1 to 4 along the plane containing the longitudinal axis of the acoustic speaker and a transverse axis defined by the loudspeakers, FIG. 6 is a detail view of the shell and the armature shown in FIGS. 1 and 2, in cross-section in the same plane as that of FIG. 5, and FIG. 7 is a front view of one of the inserts present in the shell shown in FIGS. 1 to 6.

An acoustic speaker 1 according to the invention is described in reference to FIGS. 1 and 2.

The acoustic speaker 1 is for example an active speaker, that is to say, it comprises an audio signal reader and an amplifier (not shown, just as other electrical or electronic elements of the speaker are not shown that are not relevant to explain the invention).

In the illustrated example, the acoustic speaker rests on a surface S that is preferably horizontal. The acoustic speaker for example has a generally oblong shape along a longitudinal axis L, which advantageously forms an angle with the surface S, as shown in FIG. 3. The acoustic enclosure thus has a front part 3 and a back part 5 along the longitudinal axis L, the front part being higher than the back part relative to the surface S.

The acoustic speaker comprises a metal armature 7, and a plastic shell 9 fastened on the armature, the shell defining at least two openings 11A and 11B. The acoustic speaker comprises two woofers 13A and 13B (only one of which is shown in FIG. 1) arranged back-to-back along a transverse axis T that is for example perpendicular to the longitudinal axis L. The two woofers 13A and 13B respectively extend through openings 11A and 11B.

"Woofers" refer to loudspeakers suitable for diffusing acoustic waves with frequencies lower than 1000 Hz, preferably lower than 500 Hz, still more preferably lower than 150 Hz.

The acoustic speaker 1 advantageously comprises a third loudspeaker (not shown), for example fixed in a housing 15 formed by the shell 9 in the front part 3.

The acoustic speaker comprises two metal inserts 17A and 17B, advantageously symmetrical relative to one another in a plane P perpendicular to the transverse axis T and containing the longitudinal axis L, and one of which is shown in FIG. 7.

The acoustic enclosure has a symmetrical outer appearance relative to this plane P.

The third loudspeaker (not shown) located in the housing 15 is for example centered on the longitudinal axis L. Advantageously, it is suitable for diffusing acoustic waves at frequencies from 300 Hz to 20 kHz, or from 150 Hz to 40 kHz.

The armature 7 is advantageously a foundry part, for example made from aluminum. The armature 7 comprises an outer part 19 forming the back part 5 of the acoustic speaker, and an inner part 21 secured to the outer part and extending along the plane P.

The outer part 19 and the shell 9 together define an inner volume 23 (FIG. 2) of the acoustic speaker.

The outer part 19 includes a back portion 25 including a plurality of fins 27 (FIG. 6) suitable for discharging the heat given off in the inner volume 23 during the operation of the acoustic speaker.

The outer part 19 also includes a soleplate 29 that advances under the loudspeakers 13A, 13B along the longitudinal axis L from the back portion 25.

The outer part 19 of the armature and the shell 9 are suitable for nesting in one another along a longitudinal axis L.

Seen along the transverse axis T, the outer part 19 is advantageously generally U-shaped.

One of the branches of the U is formed by the soleplate 29 and is for example larger than the other branch.

The fins 27 are for example parallel to the plane P, and advantageously delimited by a spherical enclosure 31 (FIG. 6) with the same curvature as the front part 3 of the acoustic speaker.

The outer part 19 includes a curved edge 33 defining a groove 35 in which a sealing gasket 37 forming a loop is arranged.

The curved edge 33 is adjacent to a curved edge 39 of the shell 9, the sealing gasket 37 being arranged between the two curved edges 33 and 39.

The inner part 21 forms a fastening support of the two loudspeakers 13A, 13B and the shell 9. The inner part 21 for example defines an orifice 41 (FIG. 2) suitable for fastening the loudspeaker 11B on the inner part 21. For example, a screw (not shown) is screwed in the loudspeaker 11B through the orifice 41.

The inner part 21 defines a surface 43 on which the loudspeaker 11A is for example glued.

The shell 9 is in one piece. "One piece" means that the shell 9 is in a single piece; it does not include parts attached to one another by mechanical means. The shell 9 is advantageously fastened on the inner part 21 by a single screw/nut system, including a dowel 45 fastened on the inner part, and a nut 47 screwed on this dowel. One or several washers 49 are slipped on the dowel 45 between the shell 9 and the inner part 21 to adjust the axial spacing between these two parts.

The shell 9 comprises, successively along the longitudinal axis L, a front part 51 forming a sphere portion, an intermediate part 53 forming a cylinder portion, and two back walls 55A, 55B located longitudinally behind two membranes 57A, 57B.

The shell 9 also comprises a skirt 59 (FIG. 4) located below the loudspeakers 13A, 13B and concealing part of the soleplate 29 of the armature 7.

The front part 3 of the acoustic speaker is at least partially formed by the shell 9.

The shell 9 is generally U-shaped seen along an axis E, orthogonal to the longitudinal axis L and the transverse axis T.

The front part 51 defines the aforementioned housing 15. The sphere portion formed by the front part 51 is centered on a point located on the longitudinal axis L.

The cylindrical portion formed by the intermediate part 53 is centered on the longitudinal axis L.

The back walls 55A, 55B are for example parallel to the plane P. The back walls define two rails 61A, 61B on the curved edge 39 (FIGS. 5 and 6).

The rails 61A, 61B are respectively received in grooves 63A, 63B defined by the curved edge 33 of the outer part 25 of the armature.

The rails 61A, 61B and the corresponding grooves 63A, 63B are for example circular seen along the transverse axis T.

The openings 11A, 11B are advantageously circular and centered along the transverse axis T. The openings 11A, 11B are suitable for allowing the insertion of the loudspeakers 13A, 13B into the inner volume 23 by translation along the transverse axis T.

The shell 9 comprises an inner layer 65 (FIGS. 5 and 6), delimiting the inner volume 23, and an outer layer 67, or trim layer, visible from the outside of the acoustic speaker.

The inner layer 65 is thicker than the outer layer 67. The inner layer for example includes polycarbonate (PC) reinforced with 15% to 25% by weight of glass fibers.

The outer layer 67 is for example made from acrylonitrile butadiene styrene (ABS).

The inserts 17A, 17B are advantageously structurally identical to one another. They are arranged symmetrically, as previously stated, on either side of the plane P. Therefore, only the inserts 17A will be described hereinafter in reference to FIG. 7.

The insert 17A is advantageously made from stainless steel. The insert is made from a metal sheet, for example having a thickness of between 0.6 mm and 1.5 mm.

The insert 17A comprises a circular part 69 located in an edge 71 of the shell 9 delimiting the opening 11A, and an adjacent part 73 located in the back wall 55A.

The role of the circular part is to stiffen the edge of the sheet 9 delimiting the opening 11A. Indeed, the loudspeakers 13A, 13B are rigidly fastened on the inner part 21 of the armature 7, and are devoid of any rigid connection with the shell 9 other than that formed by the armature. Therefore, the edge 71 is cantilevered relative to the loudspeaker 13. The same is true symmetrically relative to the plane P for the loudspeaker 13B and the edge of the shell delimiting the opening 11B.

The adjacent part 73 stiffens the back wall 55A. This in particular avoids pumping phenomena, that is to say, vibrations of the back wall 55A due to pressure fluctuations in the inner volume 23 caused by the transverse movement of the membranes 57A, 57B of the loudspeakers 13A, 13B.

The assembly of the acoustic enclosure 1 will now be briefly described.

To assemble the acoustic speaker, electronic elements (not shown) are first fastened on the armature 7 in the inner volume 23. Next, the armature 7 and the shell 9 are assembled by nesting along the longitudinal axis L. The rails 61A, 61B are housed in the grooves 63A, 63B. The sealing gasket 37 is compressed between the curved edge 33 and the outer part 19 of the armature and the curved edge 39 of the shell.

The nut 47 is screwed on the dowel 45 to fasten the shell on the armature 7. The fastening requires a single screw/nut system.

The number and thickness of the washers 49 makes it possible to adjust the distance between the armature and the shell along the longitudinal axis L.

The loudspeaker 13B is then introduced into the inner volume 23 through the opening 11B of the shell along the transverse axis T. The loudspeaker 13B is fastened on the inner part 21 using a screw (not shown) introduced into the orifice 41 and screwed from the opposite side of the inner part 21 relative to the loudspeaker 13B.

The loudspeaker 13A is next introduced into the inner volume 23 through the opening 11A along the transverse axis T. The loudspeaker 13A is next glued on the gluing surface 43 of the inner part 21.

Prior to their fastening, the loudspeakers 13A, 13B are electrically connected to the amplifier (not shown).

The third loudspeaker (not shown) is fastened in the housing 15.

Owing to the features described above, the assembly of the acoustic speaker is easy and the shell 9 has a smoother appearance.

The invention claimed is:

1. An acoustic speaker comprising:

a metal armature, a plastic shell fastened on the armature, the shell defining at least two openings, and at least two loudspeakers arranged back-to-back along a transverse axis (T), the two loudspeakers respectively extending through two of the at least two openings, wherein:

the shell is in one piece, the shell and an outer part of the armature are suitable for nesting in one another along a longitudinal axis, the outer part and the shell at least partially defining an inner volume of the acoustic speaker, and the armature comprises an inner part located between the two loudspeakers along the transverse axis, and the shell is rigidly fastened on the inner part.

2. The acoustic speaker according to claim 1, oblong along the longitudinal axis, a rear part of the acoustic speaker the longitudinal axis being formed by the outer part of the armature, and a front part of the acoustic speaker along the longitudinal axis being at least partially formed by the shell.

3. The acoustic speaker according to claim 1, wherein the shell is fastened on the inner part by a screw-nut system.

4. The acoustic speaker according to claim 1, wherein the two loudspeakers are rigidly fastened on the inner part of the armature, and are devoid of any rigid connection with the shell other than that formed by the armature.

5. The acoustic speaker according to claim 1, wherein the shell and the outer part of the armature respectively include two curved edges, the two curved edges being adjacent to one another, the acoustic enclosure including a sealing gasket arranged between the two curved edges and forming a loop extending along the two curved edges.

6. The acoustic speaker according to claim 1, wherein:

the shell is generally U-shaped seen along an axis orthogonal to the longitudinal axis and the transverse axis; and the outer part of the armature is generally U-shaped seen along the transverse axis.

7. The acoustic speaker according to claim 1, wherein the two openings are respectively delimited by two edges, the acoustic speaker comprising at least two metal inserts respectively overmolded by said two edges.

8. The acoustic speaker according to claim 1, wherein:

each of the two loudspeakers comprises a membrane suitable for emitting sound waves, and the shell comprises, successively along the longitudinal axis, a front part forming a sphere portion, an intermediate part forming a cylinder portion, and two back walls located longitudinally behind the membranes of the two loudspeakers.

9. The acoustic speaker according to claim 8, further comprising two metal inserts respectively overmolded by the back walls of the shell.

10. The acoustic speaker according to claim 1, wherein the shell comprises:

an inner layer including polycarbonate, and between 15% and 25% by weight of glass fibers, and an outer layer including acrylonitrile butadiene styrene.

11. An acoustic speaker comprising:

a metal armature, a plastic shell fastened on the armature, the shell defining at least two openings, and at least two loudspeakers arranged back-to-back along a transverse axis (T), the two loudspeakers respectively extending through the two openings, wherein:

the shell is in one piece, the shell and an outer part of the armature are suitable for nesting in one another along a longitudinal axis, the outer part and the shell at least partially defining an inner volume of the acoustic speaker, and the shell and the outer part of the armature respectively include two curved edges, the two curved edges being adjacent to one another, the acoustic enclosure including a sealing gasket arranged between the two curved edges and forming a loop extending along the two curved edges.

12. An acoustic speaker comprising:

a metal armature, a plastic shell fastened on the armature, the shell defining at least two openings, and at least two loudspeakers arranged back-to-back along a transverse axis (T), the two loudspeakers respectively extending through the two openings, wherein:

the shell is in one piece, the shell and an outer part of the armature are suitable for nesting in one another along a longitudinal axis, the outer part and the shell at least partially defining an inner volume of the acoustic speaker, and the two openings are respectively delimited by two edges, the acoustic speaker comprising at least two metal inserts respectively overmolded by said two edges.

13. The acoustic speaker according to claim 3, wherein the shell is fastened on the inner part by a single screw-nut system.

14. The acoustic speaker according to claim 7, wherein the two edges are circular.

* * * * *